US007607446B2

(12) United States Patent
Zheng

(10) Patent No.: US 7,607,446 B2
(45) Date of Patent: Oct. 27, 2009

(54) COLLAPSIBLE COVERS AND SHADES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 43 days.

(21) Appl. No.: 10/806,918

(22) Filed: Mar. 22, 2004

(65) Prior Publication Data

US 2005/0205123 A1 Sep. 22, 2005

(51) Int. Cl.
*E04H 15/40* (2006.01)

(52) U.S. Cl. ..... 135/126

(58) Field of Classification Search ..... 135/125, 135/126; 160/351, 354
See application file for complete search history.

(56) References Cited

U.S. PATENT DOCUMENTS 4,815,784 A 3/1989 Zheng
5,024,262 A 6/1991 Huang
5,038,812 A 8/1991 Norman
5,467,794 A 11/1995 Zheng
5,722,446 A 3/1998 Zheng
6,006,772 A 12/1999 Zheng
6,030,300 A 2/2000 Zheng
6,073,283 A 6/2000 Zheng
6,082,386 A 7/2000 Zheng
6,098,349 A 8/2000 Zheng
6,155,281 A * 12/2000 Zheng ..... 135/126
6,170,100 B1 1/2001 Le Gette et al.
6,192,635 B1 2/2001 Zheng
6,220,265 B1 4/2001 Zheng
6,267,128 B1 7/2001 Zheng
6,267,129 B1 7/2001 Zheng
6,289,910 B1 9/2001 Zheng
6,305,396 B1 10/2001 Zheng
6,318,394 B1 * 11/2001 Zheng ..... 135/126
6,325,086 B1 * 12/2001 Shinner et al. ..... 135/126
6,343,391 B1 2/2002 Le Gette et al.
6,357,510 B1 3/2002 Zheng
6,360,761 B1 3/2002 Zheng
6,390,111 B2 5/2002 Zheng
6,446,396 B1 * 9/2002 Marangoni et al. ..... 52/36.1
6,453,923 B2 9/2002 Zheng
6,491,052 B1 12/2002 Zheng
6,502,595 B2 * 1/2003 Louie ..... 135/125
6,560,095 B1 5/2003 Zheng
6,581,313 B1 6/2003 Zheng
6,604,537 B2 8/2003 Zheng
6,684,894 B2 2/2004 Zheng
6,694,994 B1 2/2004 Zheng
6,698,441 B1 3/2004 Zheng
6,782,905 B2 * 8/2004 Chu et al. ..... 135/143
2001/0039959 A1 * 11/2001 Zheng ..... 135/126
2002/0112753 A1 * 8/2002 Louie ..... 135/125
2003/0066552 A1 * 4/2003 Zheng ..... 135/126
2003/0213511 A1 * 11/2003 Louie ..... 135/125

OTHER PUBLICATIONS

"Ameristep" 2003 Product Catalog: pp. 11-13, 18, 19 for Trophyhouse, Spur Blinds, Jakehouse, Treehouse, Ultimate Umbrella.

* cited by examiner

*Primary Examiner*—David Dunn
*Assistant Examiner*—Noah Chandler Hawk
(74) *Attorney, Agent, or Firm*—Raymond Sun

(57) ABSTRACT

Assemblies and structures are disclosed having one or more collapsible panels that are positioned to cover a variety of objects, including but not limited to boxes, furniture items, lamps, clocks, doors and windows. The panels are provided to act as covers, shades, dividers, partitions or canopies.

3 Claims, 12 Drawing Sheets

COLLAPSIBLE COVERS AND SHADES

BACKGROUND OF THE INVENTION

1. Field of the Invention

The present invention relates to collapsible structures, and in particular, to covers, shades and similar apparatus that can be used to cover or surround another object, and which may be twisted and folded to reduce the overall size of the assembly to facilitate convenient storage and use.

2. Description of the Prior Art

Collapsible objects have recently become very popular. Examples of such collapsible objects are shown and described in U.S. Pat. No. 5,038,812 (Norman), U.S. Pat. No. 5,467,794 (Zheng) and U.S. Pat. No. 5,560,385 (Zheng) in the form of collapsible structures. These structures can be used as play structures, shelters, tents, and storage structures, among other uses. These structures may be twisted and folded to reduce the overall size of the structures to facilitate convenient storage and use. As such, these structures are being enjoyed by many people in many different applications.

Other examples of collapsible objects include blanket, mat and floating assemblies as illustrated in one or more of U.S. Pat. No. 6,073,283 (Zheng), U.S. Pat. No. 6,170,100 (Le Gette et al.) and U.S. Pat. No. 6,343,391 (Le Gette et al.). These assemblies can be used as blankets, floor mats, and floating mats. These blankets and mats may be twisted and folded to reduce the overall size of the blanket or mat to facilitate convenient storage and use.

Yet other examples of collapsible objects include sunshades, as illustrated in U.S. Pat. No. 4,815,784 (Zheng) and U.S. Pat. No. 5,024,262 (Huang). U.S. Pat. No. 6,192,635 (Zheng) illustrates a large variety of other collapsible objects, while U.S. Pat. No. 6,581,313 (Zheng) illustrates collapsible flags, signage and umbrellas.

SUMMARY OF THE DISCLOSURE

It is an object of the present invention to provide a cover or shade that can be folded and collapsed into a smaller configuration for convenient storage and transportation.

It is another object of the present invention to provide a collapsible cover or shade for household items, including furniture.

It is yet another object of the present invention to provide collapsible partitions, screens, window covers, door covers, lamp covers, and clock covers.

In order to accomplish the objects of the present invention, there are provided assemblies and structures having one or more collapsible panels that are positioned to cover a variety of objects, including but not limited to boxes, furniture items, lamps, clocks, doors and windows. The panels are provided to act as covers, shades, dividers, partitions or canopies.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figures 1, 2:
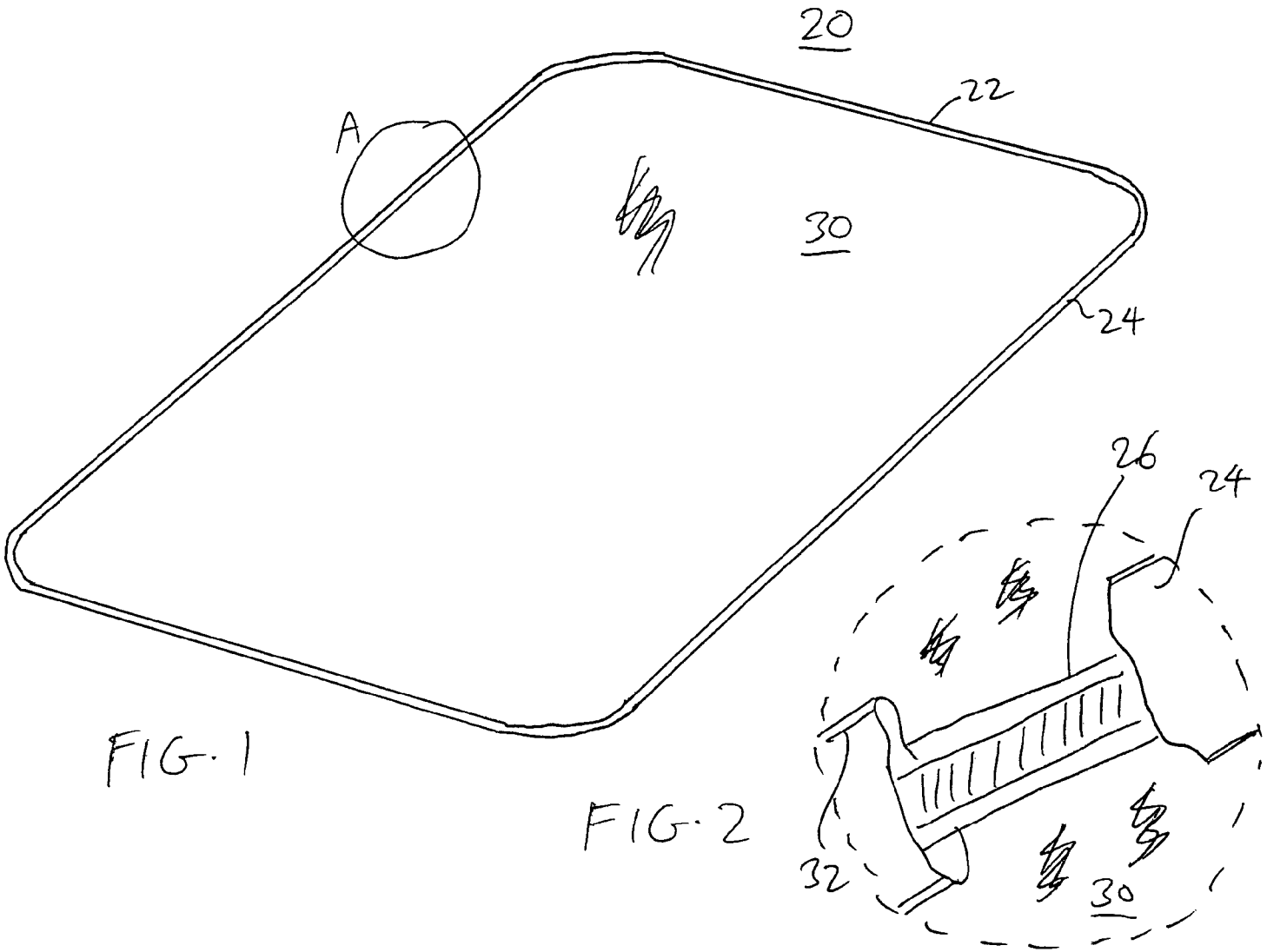
FIG. 1 is a perspective view of a panel according to the present invention.
FIG. 2 is a cross-sectional view of the panel of FIG. 1 taken from the region A thereof.

The collapsible structures according to the present invention are configured in the form of one or more basic panels that are assembled together to create a resulting structure having the desired shape and size. FIGS. 1 and 2 illustrate the construction of a basic panel 20. The panel 20 is shown as having four sides, but can be configured to have any number of sides, depending on the desired shape (e.g., circular, oval, or rectangular, square, trapezoidal, or irregular). The panel 20 has a peripheral edge 22 that extends all the way around the panel 20. A peripheral frame retaining sleeve 24 is provided along and traverses the peripheral edge 22, and a continuous frame member 26 is retained or held within the frame retaining sleeve 24 such that the frame member 24 extends completely around the peripheral edge 22.

The continuous frame member 26 may be provided as one continuous loop, or may be a strip of material connected at both ends to form a continuous loop. The continuous frame member 26 is preferably formed of flexible coilable steel, although other materials such as plastics may also be used. The frame member 26 should be made of a material which is relatively strong and yet is flexible to a sufficient degree to allow it to be coiled. Thus, the frame member 26 is capable of assuming two positions, an open or expanded position such as shown in FIG. 1, or a folded position (see FIG. 3E) in which the frame member 26 is collapsed into a size which is much smaller than its open position. The frame member 26 may be merely retained within the frame retaining sleeve 24 without being connected thereto. Alternatively, the frame retaining sleeve 24 may be mechanically fastened, stitched, fused, or glued to the frame member 26 to retain the frame member 26 in position.

Sheet material 30 extends across the interior space defined by the sleeve 24, and is held taut by the frame member 26 when the sheet material 30 is in its open position. The term "sheet material" is to be given its broadest meaning and should be made from strong, flexible yet lightweight materials and may include woven fabrics, sheet fabrics, meshed fabrics or even films. The sheet material 30 can be water-resistant and durable to withstand the wear and tear associated with extended use, and rough treatment by adults and children. The peripheral sleeve 24 may attached to the sheet material 30 by a stitching 32. The stitching 32 can also operate to enclose the peripheral sleeve 22. Alternatively, the peripheral sleeve 24 can be a part of or an extension of the sheet material 30, where the outer edge of the sheet material 30 is wrapped around the frame member 26 to enclose the frame member 26, and then a stitching is applied to enclose the sleeve 24.

Figure 3A:
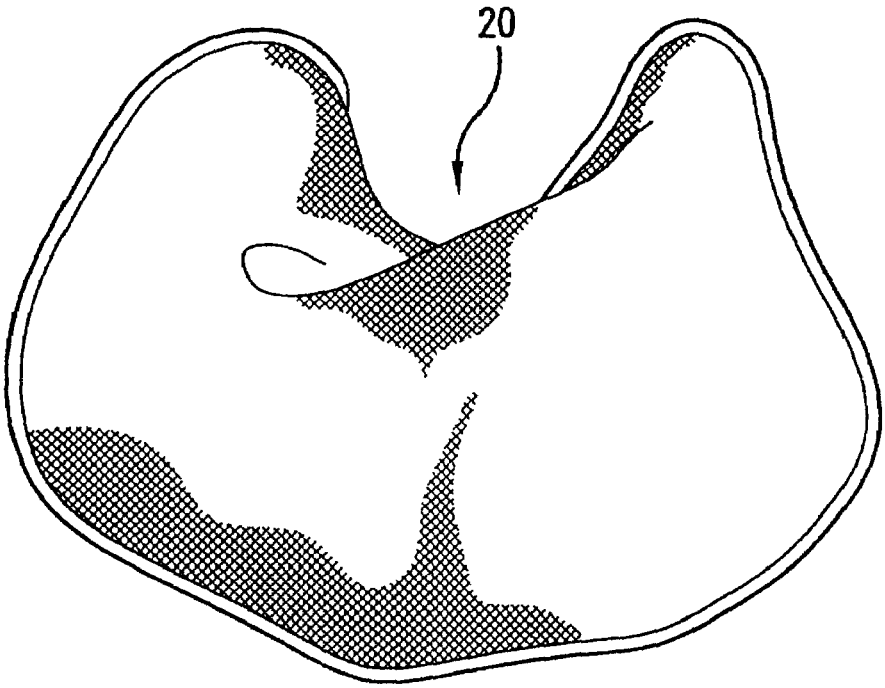
FIGS. 3A-3E illustrate how the panel of FIG. 1 can be twisted and folded for compact storage.
Figure 3B:
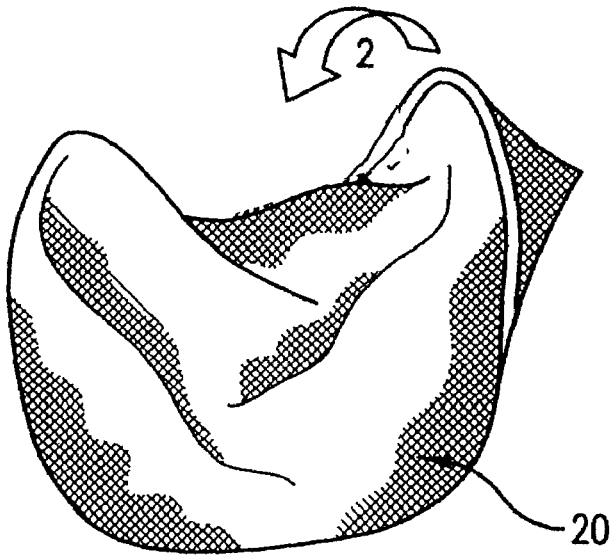
Figure 3C:
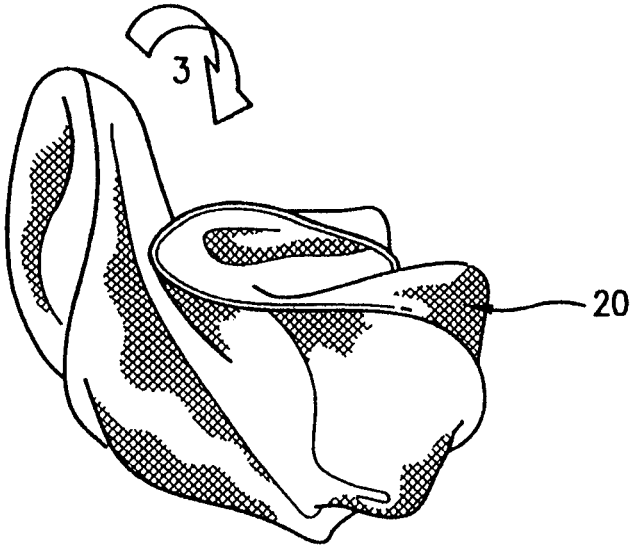
Figure 3D:
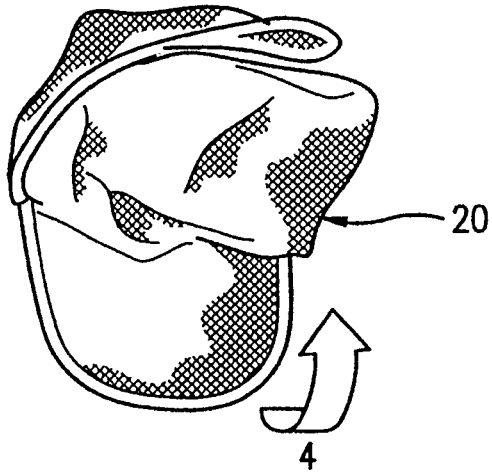
Figure 3E:
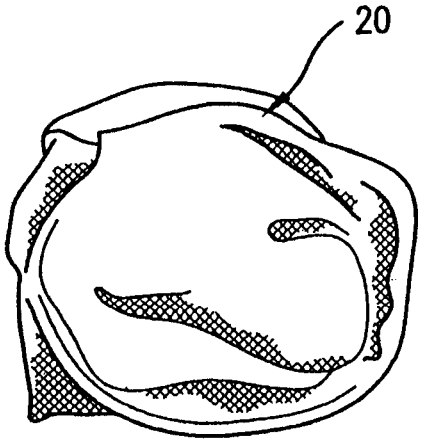

The panel 20 can then be folded and collapsed into a compact configuration for storage, as illustrated in FIGS. 3A-3E. In the first step illustrated in FIGS. 3A-3C, the opposite border of the panel 20 is folded in to collapse the frame member 26 with the sheet material 30. As shown in FIG. 3D, the next step is to continue the collapsing so that the initial size of the panel 20 is reduced. FIG. 3E shows the next step with the frame member 26 and sheet material 30 collapsed on each other to provide for a small essentially compact configuration having a plurality of concentric frame members 26 and layers of the sheet material 30 so that the collapsed panel 20 has a size which is a fraction of the size of the initial panel 20, as shown in FIG. 3E.

When the frame member 26 is in the collapsed position, the closed loop of the frame member 26 consists of three loop rings intertwined to lie flat. In the collapsed position, the panel 20 will have a significantly reduced diameter which makes it easy to store the collapsed panel 20.

The panel 20 can be expanded again by opening the coiled frame member 26. The bias and resiliency of the frame member 26 will cause the frame member 26 (and the attached sheet material 30) to automatically open out to the expanded position shown in FIG. 1.

Figure 4:
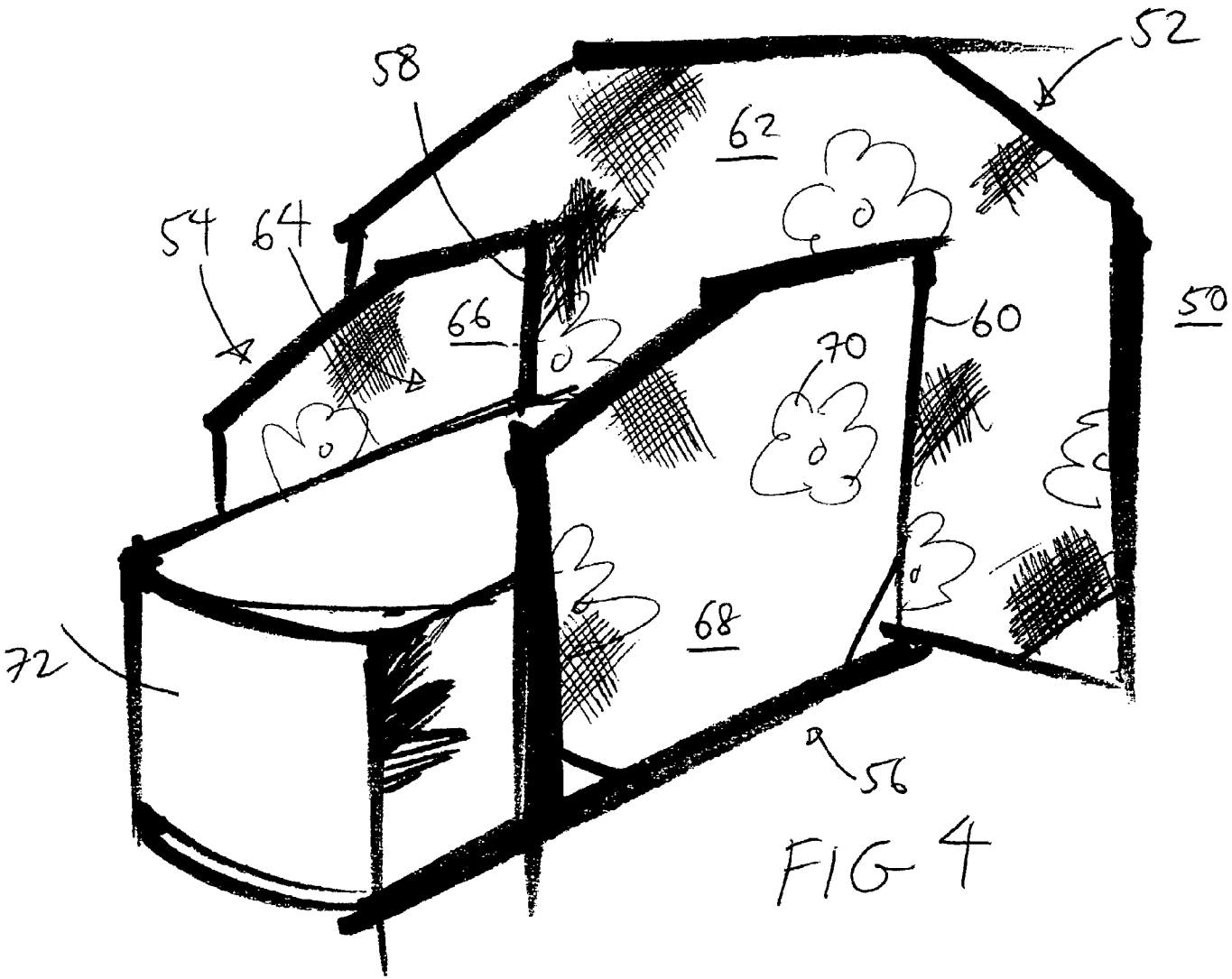
FIGS. 4-14 illustrate different embodiments of collapsible structures according to the present invention.

FIG. 4 illustrates one embodiment of a collapsible structure 50 according to the present invention. The structure 50 has three separate panels 52, 54 and 56, each having a construction that is the same as the panel 20, but having different shapes. Two of the panels 54, 56 have a side edge 58 and 60, respectively, that is attached to the sheet material 62 of the other panel 52. This attachment can be the same as that which is described in connection with FIGS. 1-3 of U.S. Pat. No. 6,267,128 (Zheng), whose entire disclosure is incorporated by this reference as though set forth fully herein. The two panels 54 and 56 define a space 64 therebetween. Any object or item can be placed in the space 64, or adjacent the outer sides of the panels 54 and 56. For example, FIG. 4 illustrates a box or footlocker 72 that is placed inside the space 64 so as to be completely covered on three of its sides by the three panels 52, 54, 56. In addition to the box 72, a table, a nightstand or other piece of furniture can also be placed inside the space 64 so as to be completely covered on its three sides by the three panels 52, 54, 56. The outer surface of the sheet materials 62, 66 and 68, of the panels 52, 54, 56, respectively, can be provided with any desired ornamental pattern, design, logo, or emblem 70 for decorative purposes.

Thus, the structure 50 can be used as a furniture cover, where the panels 50, 52, 54 are used to cover some of the sides of a table, chair, box or bed (among other types of furniture) so that other people can only see the decorative sides defined by the panels 50, 52, 54. As a result, the user can vary the decorative designs for a piece of furniture by purchasing a plurality of structures 50 (each having different designs) and using different structures 50 at different times. This is an especially cost-effective way for decorating simple furniture, or allowing a piece of furniture to blend into the colors and designs of the rest of the furniture or paint colors in a room. For example, a simple and aesthetically unpleasant (e.g., unfinished) side table or box can be decorated by alternating different structures 50 having different designs, or blended into a new room (or among other furniture items) by providing a structure 50 having a matching color or design.

The structure 50 can be collapsed into a smaller configuration by folding the panels 54, 56 flat onto the panel 52, and then twisting and folding the entire structure 50 using the principles illustrated in FIGS. 3A-3E.

Figure 5:
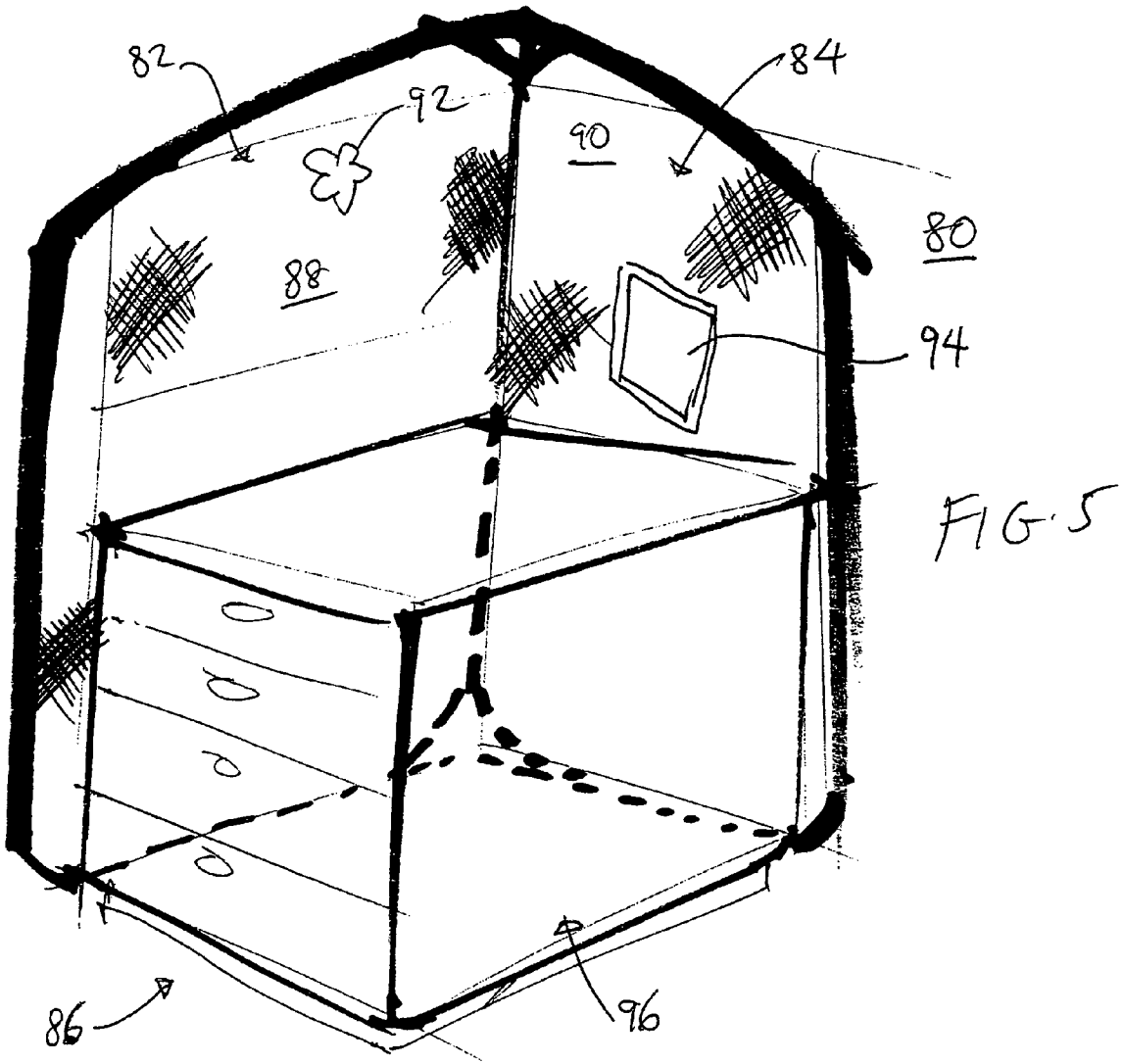

FIG. 5 illustrates another embodiment of a collapsible structure 80 according to the present invention that can also perform the same functions as the structure 50 in FIG. 4. The structure 80 has two separate panels 82, 84, each having a construction that is the same as the panel 20, but having different shapes. The panels 82, 84 are hingedly connected to each other along a side edge thereof. This hinged connection can be the same as that which is described in connection with FIGS. 1 and 3A-3F of U.S. Pat. No. 5,778,915 (Zheng), or FIGS. 1, 4 and 9-16 of U.S. Pat. No. 6,220,265 (Zheng), whose entire disclosures are incorporated by this reference as though set forth fully herein. As described in U.S. Pat. No. 5,778,915 (Zheng) and U.S. Pat. No. 6,220,265 (Zheng), this hinged connection includes stitching a side edge of one panel to the side edge of another panel. The two panels 82, 84 define a space 86 therebetween when they are upright in a vertical orientation. Any object or item can be placed in the space 86. For example, FIG. 5 illustrates a chest of drawers 96 positioned in the space 86 and having two sides covered by the panels 82 and 84. The inner and outer surfaces of the sheet materials 88 and 90, of the panels 82, 84, respectively, can be provided with any desired ornamental pattern, design, logo, emblem 92 for decorative purposes. Openings 94 can also be provided in one or both of the sheet materials 88 and/or 90.

The structure 80 can be collapsed into a smaller configuration by folding the panels 82, 84 against each other to form a stack of two flat panels 82, 84, and then twisting and folding the entire structure 80 using the principles illustrated in FIGS. 3A-3E.

Not only can the structure 80 be used as a furniture cover for a table, chair or bed (among other types of furniture), the structure 80 can even be positioned in an upright position (as shown in FIG. 5) and used as a screen, a partition, or even a play structure, with the opening 94 acting as a window.

In addition, the dimensions of the two panels 82, 84 can be varied so that the two panels 82, 84 do not have to be of the same size or shape. For example, the panels 82, 84 can be provided in different shapes so that they can adequately cover an object that has an irregular shape. As another example, the panels 82, 84 can have different lengths to cover two adjacent sides of a rectangular object. In this regard, the panel 82 in FIG. 5 is slightly wider than the panel 84 so as to adequately cover a rectangular chest of drawers 96.

The principles illustrated in FIG. 5 can be modified and extended as shown in FIGS. 6A-12.

Figures 6A, 7:
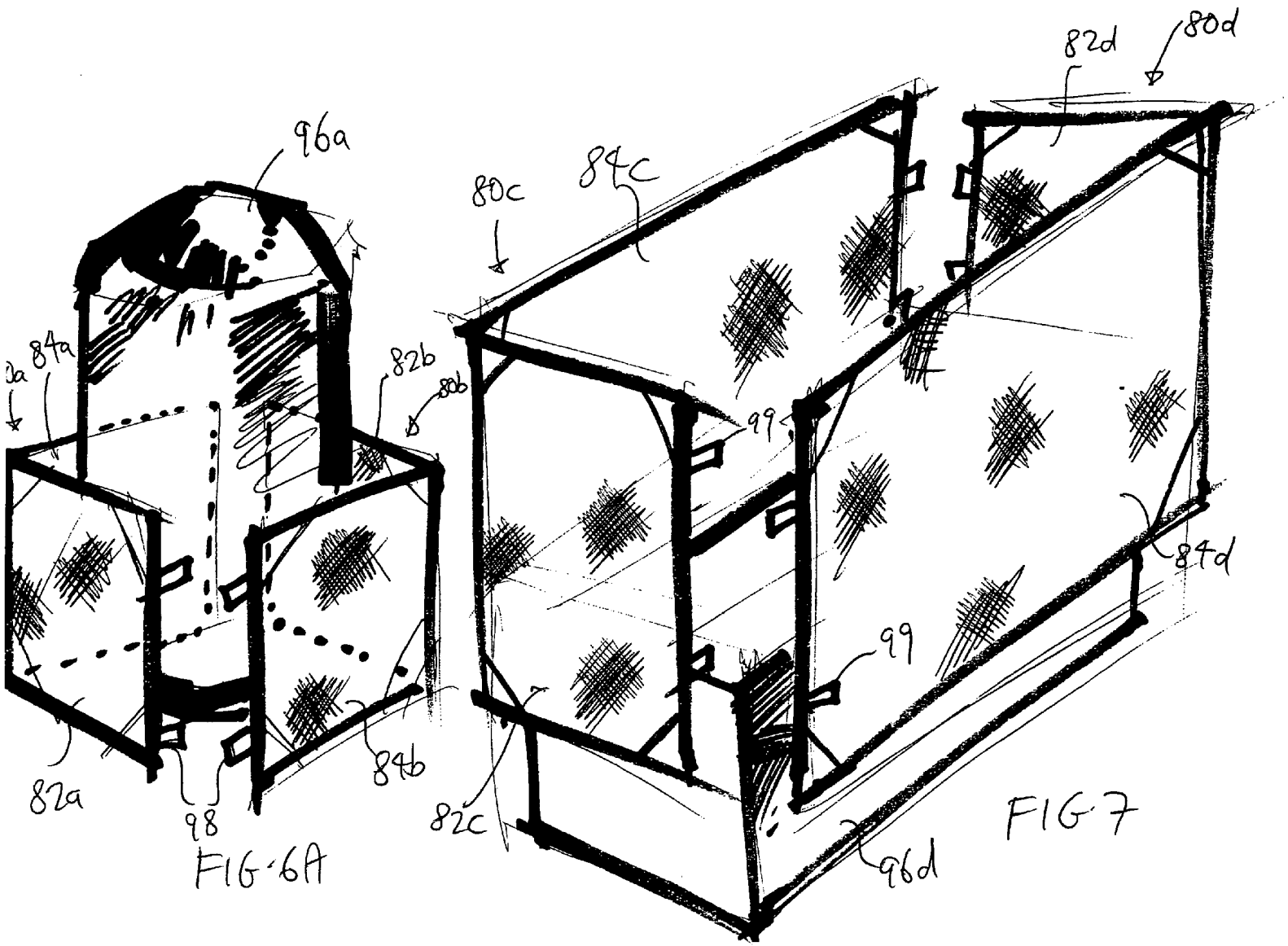

Referring first to FIG. 6A, two separate structures 80*a* and 80*b*, each of which can be identical in construction (but may have different shapes and sizes) to the structure 80, are provided, and detachable connectors 98 (e.g., hooks, ties, VELCRO™ pieces, etc.) can be provided along the unattached side edges of the panels 82*a*, 82*b*, 84*a*, 84*b* for removably attaching the two structures 80*a*, 80*b* together. When the structures 80*a*, 80*b* are attached in this manner, they can be used to completely cover the four sides of any four-sided object or furniture 96*a* (e.g., bed, table, chair, cabinet, etc.).

Similarly, in FIG. 7, two separate structures 80*c* and 80*d* are provided, each of which is the same in construction as the structure 80 except that they are provided in different shapes. Here, the panels 84*c*, 84*d* are wider than the panels 82*c*, 82*d*. Detachable connectors 99 (e.g., hooks, ties, VELCRO™ pieces, etc.) can be provided along the unattached side edges of the panels 82*c*, 82*d*, 84*c*, 84*d* for removably attaching the two structures 80*c*, 80*d* together. When the structures 80*c*, 80*d* are attached in this manner, they can also be used to completely cover the four sides of any four-sided object or furniture 96*d* (e.g., bed, table, chair, cabinet, etc.).

Figure 6B:
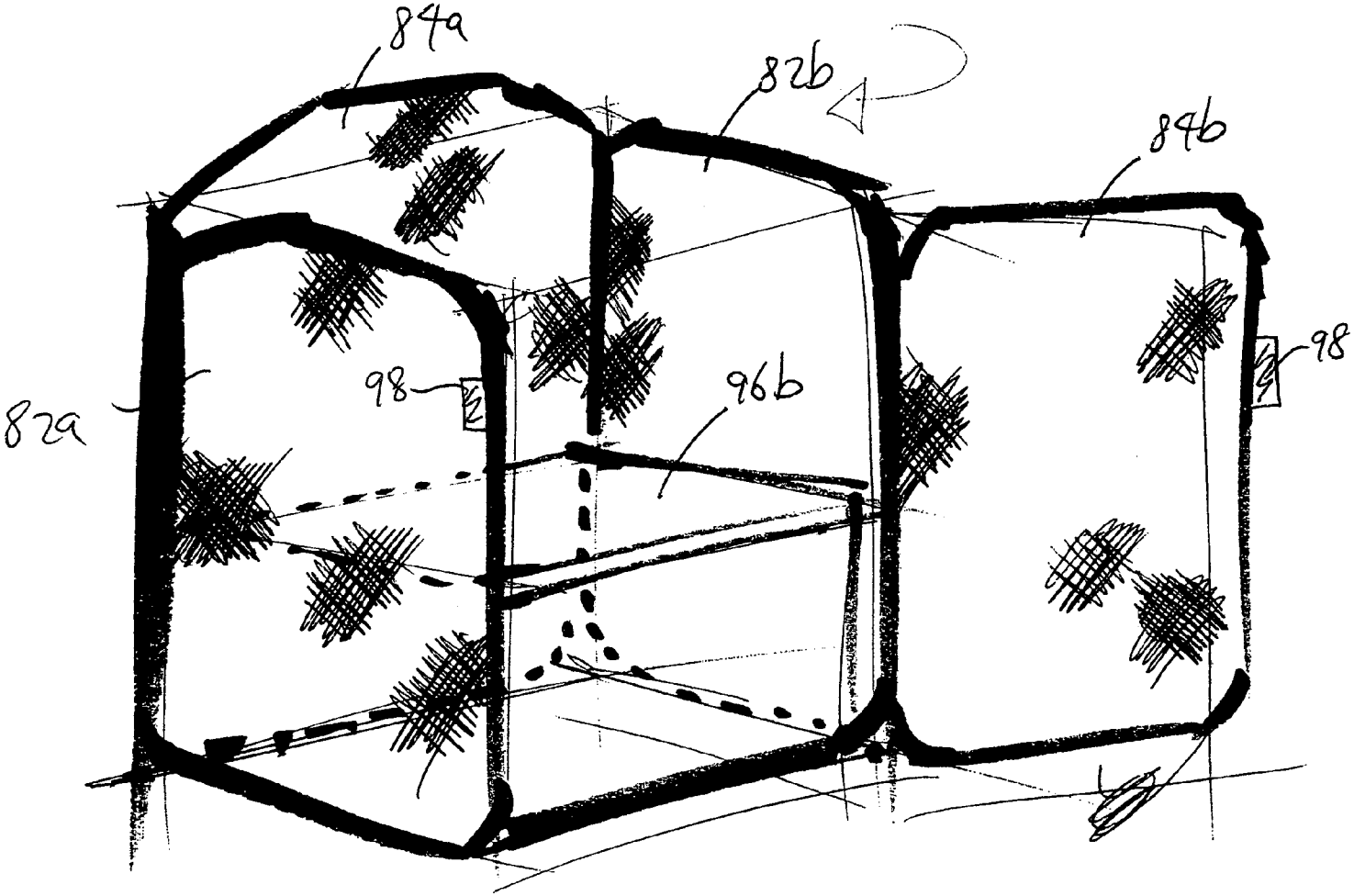

The structures in FIGS. 6A and 7 can be further modified by hingedly connecting all four panels together, while leaving one free unattached side in two of the panels. For example, the panels 82*a*, 84*a*, 82*b*, 84*b* in FIG. 6A can all be hingedly attached to each other, with each of the panels 82*a* and 84*b* having one free unattached side that has connectors 98 provided therealong for connecting the two panels 82*a*, 84*b* when necessary. This is illustrated in FIG. 6B, with the panels 82*a*, 84*a*, 82*b*, 84*b* covering an object 96*b*.

Figure 8:
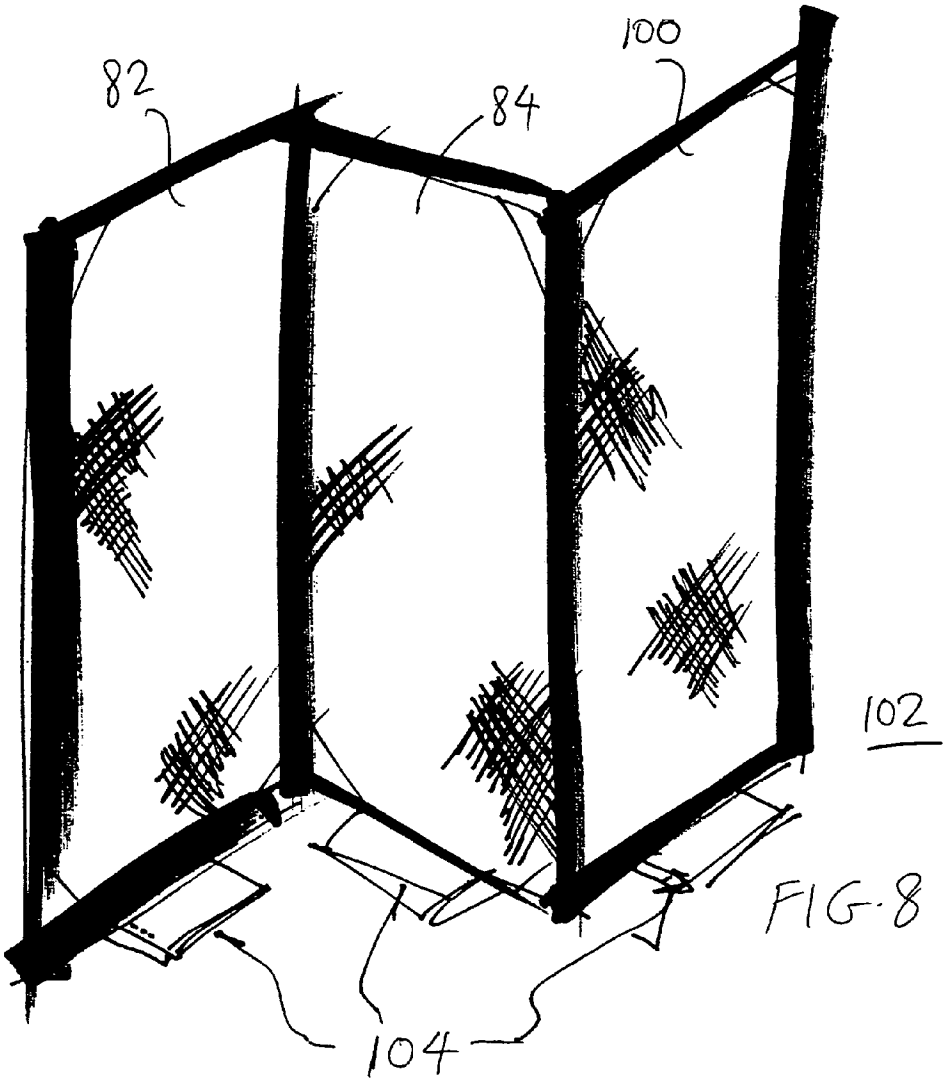

FIG. 8 illustrates a structure 102 where another panel 100 is hingedly connected (using any of the hinged connections described above) to the panel 84 of the structure 80 in FIG. 5. Another way to look at the structure 102 is that it is a modification of FIG. 6B with the panel 84*b* removed or omitted. Weights 104 can be attached to the bottom side of each panel 82, 84, 100 so that the structure 102 can be used as a screen or partition that separates the space within a room or open area, or to separate different objects or furniture items. Although only FIG. 8 shows the provision of weights 104, weights 104 can be provided at any desired location on any of the panels illustrated in any of the embodiments of the present invention.

Figures 9, 11, 12:
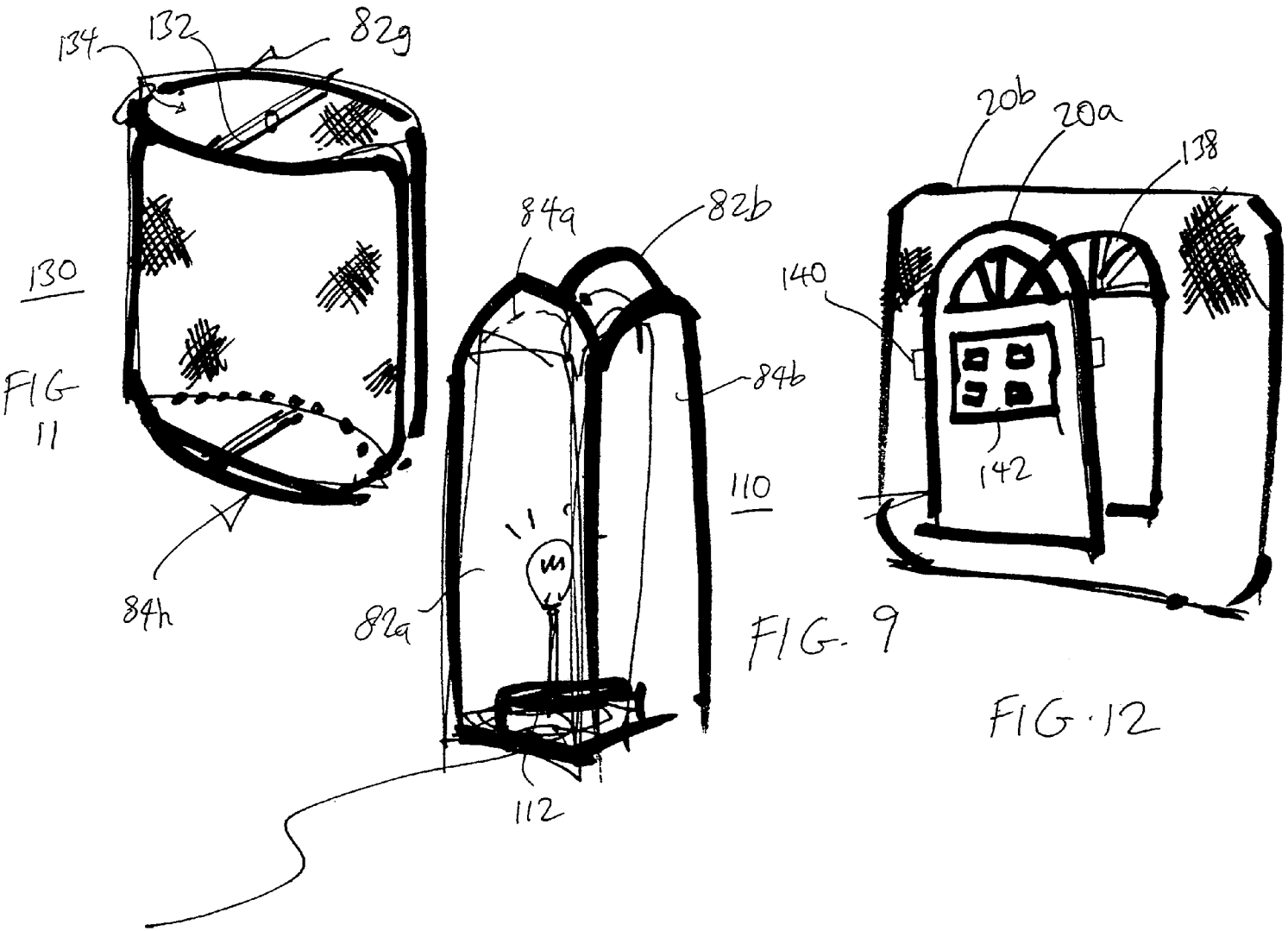

The structures in FIGS. 6A-7 can be further modified by hingedly connecting all four panels together to form a ring of flat panels. For example, the panels 82*a*, 84*a*, 82*b*, 84*b* in FIG. 6A can all be hingedly attached to each other in the same manner as described in U.S. Pat. No. 5,301,705 (Zheng) or U.S. Pat. No. 5,816,279 (Zheng), whose entire disclosures are incorporated by this reference as though set forth fully herein. For example, FIG. 9 illustrates a lamp cover 110 which is formed by a ring of four panels, such as panels 82*a*, 84*a*, 82*b*, 84*b* in FIG. 6A, where all the sides of the panels 82*a*, 84*a*, 82*b*, 84*b* are hingedly connected to a side of an adjacent panel. Here, the user can purchase a single lamp base 112 and a plurality of lamp covers 110 having different shapes, sizes, colors and decorations, so that the user can change the look of the lamp on different occasions, or as desired. The lamp cover 110 can be collapsed by folding the four panels 82*a*, 84*a*, 82*b*, 84*b* on top of each other in the manner described in U.S. Pat. No. 5,816,279 (Zheng) to form a stack of panels, and then applying the steps illustrated in FIGS. 3A-3E.

Figure 10:
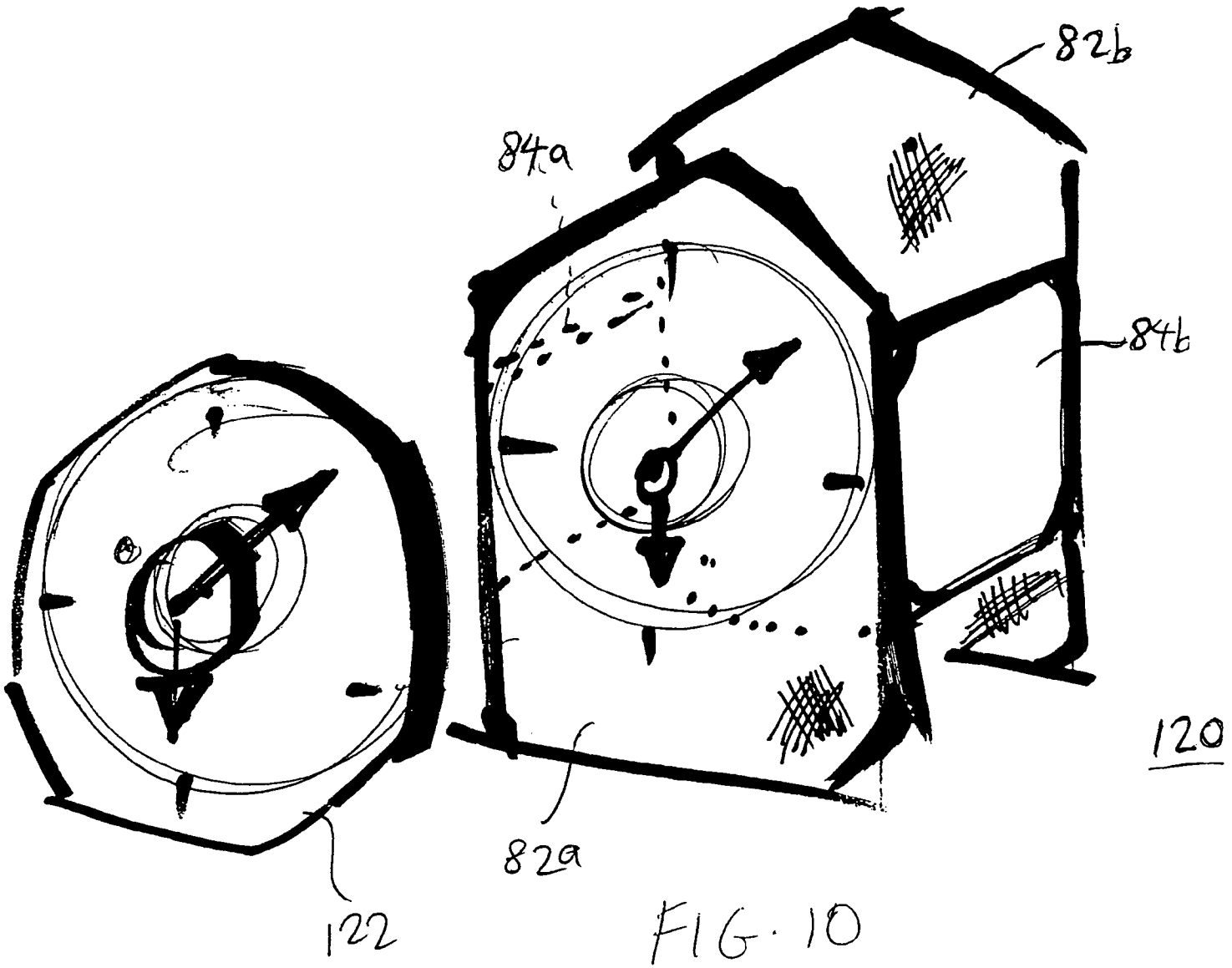

Similarly, FIG. 10 illustrates a clock support 120 which is also formed by a ring of four panels, such as panels 82*a*, 84*a*, 82*b*, 84*b* in FIG. 6A, where all the sides of the panels 82*a*, 84*a*, 82*b*, 84*b* are hingedly connected to a side of an adjacent panel. A clock face 122 can be removably coupled (e.g., by VELCRO™ pads, hooks, etc.) to one of the panels 82*a*, 84*a*, 82*b*, 84*b*. Here, the user can purchase a single clock face 122 and a plurality of clock supports 120 having different shapes, sizes, colors and decorations, so that the user can change the look of the clock on different occasions, or as desired. In addition, FIG. 10 illustrates that the panels 84*a*, 84*b* can be made smaller than the panels 82*a*, 82*b* to provide the overall clock with a different aesthetic appeal.

The structure 80 in FIG. 5 can be further modified by forming the panels 82, 84 in a curved configuration, and then attaching (either removably or hingedly, as appropriate) the sides of the panels 82, 84. For example, FIG. 11 illustrates a lamp cover 130 that is formed by attaching the sides of the curved panels 82*g*, 84*h*. The connected curved panels 82*g*, 84*h* define an interior space 134 which is adapted to house or retain a lamp (not shown). Bars or other spacing mechanisms 132 can be positioned between the central portions of the panels 82*g*, 84*h* to maintain the panels 82*g*, 84*h* in their curved configurations. The cover 130 can be used for other applications (other than as a lamp cover), such as a cage, a basket, and a hamper, among other applications. The cover 130 can be collapsed by removing the spacing mechanism 132, and folding the panels 82*g*, 84*h* on top of each other to form a stack of panels, and then applying the steps illustrated in FIGS. 3A-3E.

The single panel 20 illustrated in FIGS. 1 and 2 can itself be used as a cover, shade or partition. For example, FIG. 12 illustrates a panel 20*a* that can have the same construction as the panel 20, with the panel 20*a* used as a window cover or door cover. Connectors 140 can be provided on the panel 20*a* to allow the panel 20*a* to be secured to a window or a door. Openings 142 can be provided in the panel 20*a* at the location of the actual window or door. The panel 20*a* can be provided together with another panel 20*b* to further enhance the aesthetics of a door or window. This panel 20*b* can have the same construction as the panel 20, and sized larger than the panel 20*a*, so that the panel 20*b* can actually be secured to the window or door (using connectors similar to connectors 140), with the panel 20*a* removably secured to the panel 20*b* at the location of the door or the window, as shown in FIG. 12. The panel 20*b* can also have an opening 138 that is aligned with the opening 142. Thus, the panel 20*b* provides a permanent background or border for a door or window, and the user can removably attach different panels 20*a* to the background panel 20*b* to vary the look and feel of the door or window. Additional panels (not shown) having the same construction (but possibly having different shapes and sizes) as the panel 20 can be "sandwiched" between the panels 20*a*, 20*b* to enhance or vary the aesthetics of the door or window.

Figure 13:
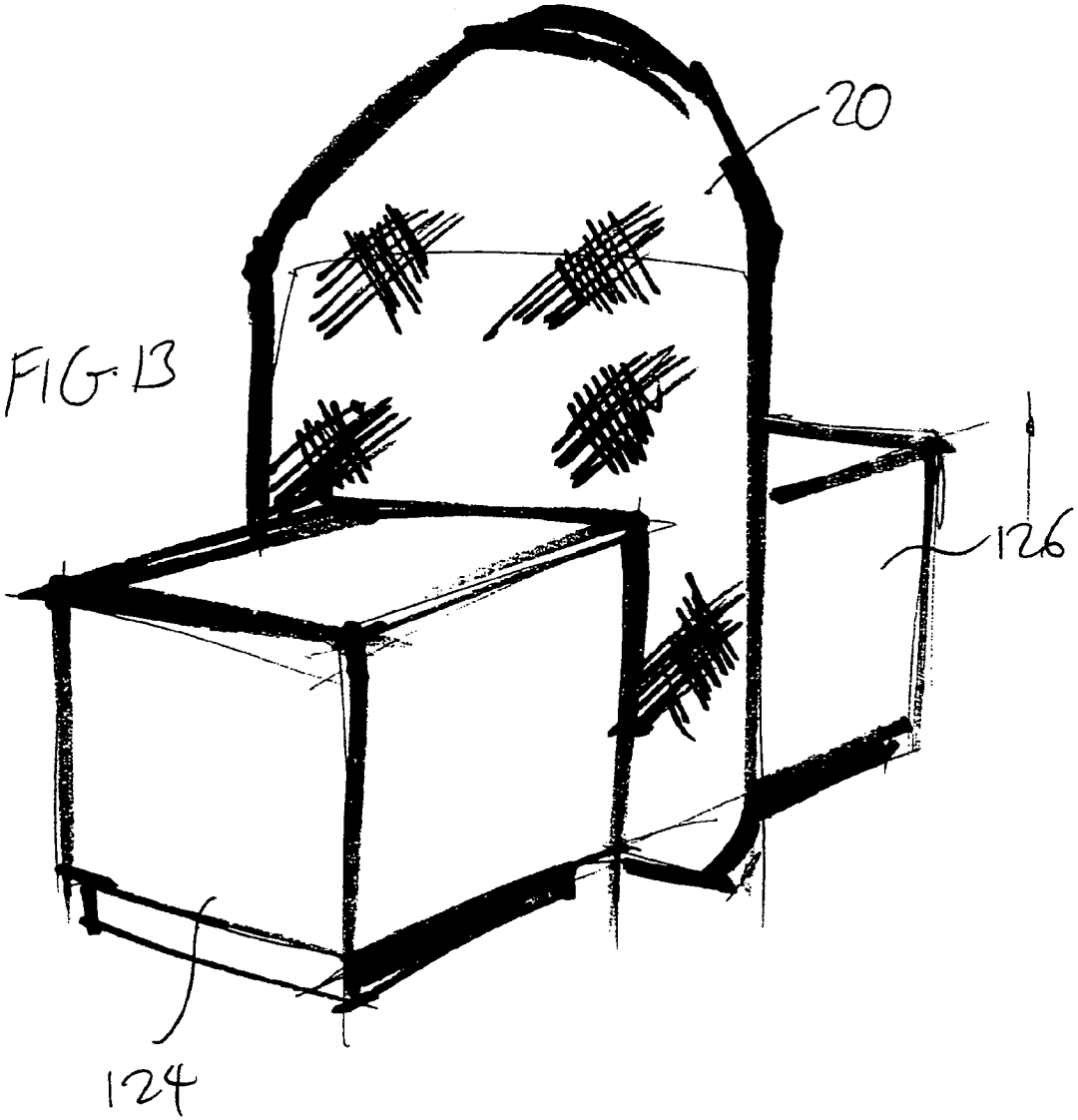

As another example, FIG. 13 illustrates the single panel 20 of FIG. 1 (but having a slightly different shape) in use as a partition or divider between two objects 124 and 126 (e.g., boxes).

Figure 14:
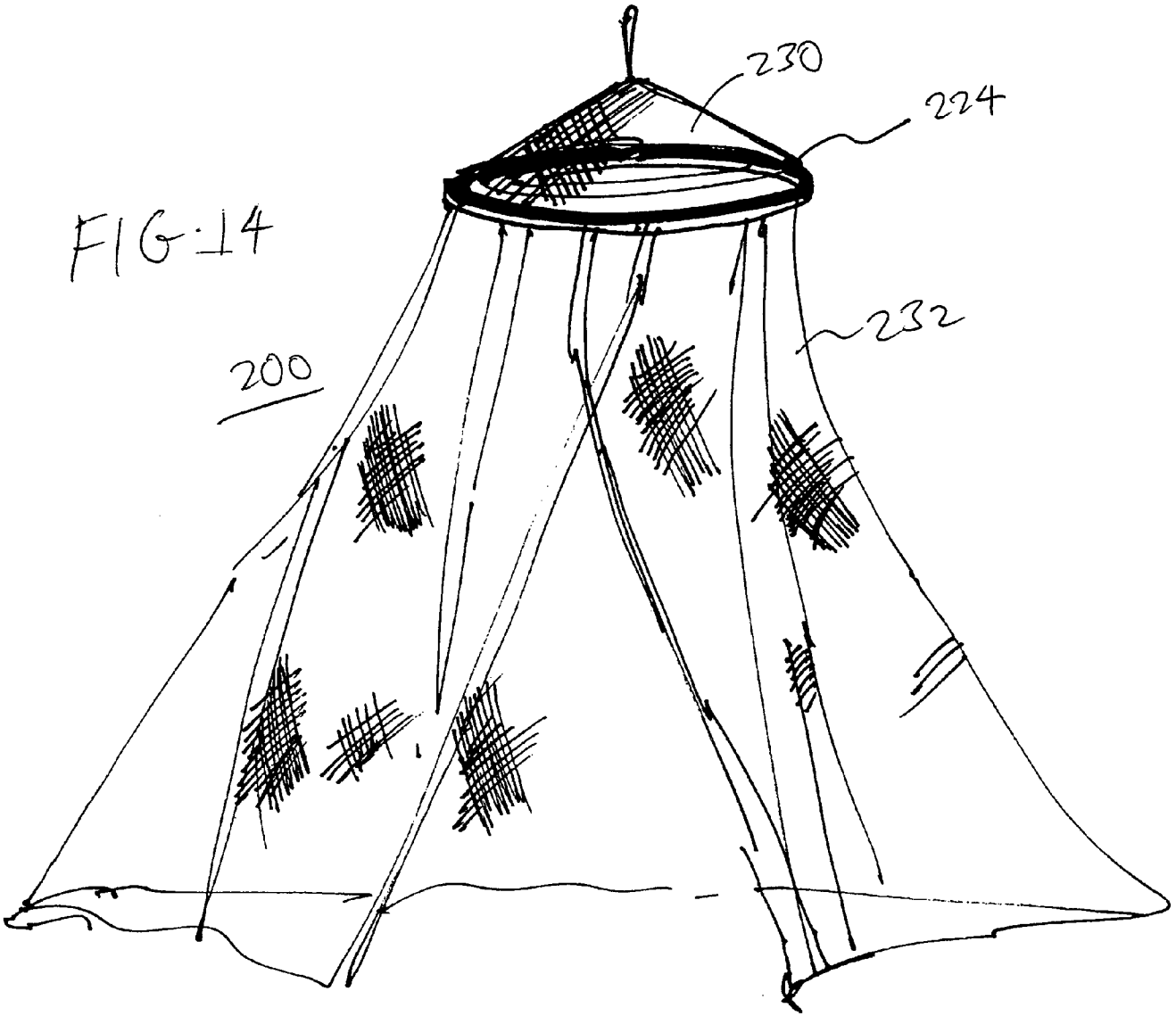

FIG. 14 illustrates a collapsible canopy 200 as a different embodiment according to the present invention. The canopy 200 has a frame member (not shown, but the same as frame member 26) that is retained in a peripheral frame retaining sleeve 224. A fabric material 230 extends across the interior space defined by the sleeve 224, and is held loosely by the frame member to define a domed configuration when the fabric material 330 is in its open position. A fabric curtain 232 extends downwardly from the peripheral sleeve 224. The frame member can be collapsed using the techniques illustrated in FIGS. 3A-3E.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. In combination:

an item of furniture;

a first structure having a first panel and a second panel; and a second structure having a third panel and a fourth panel, the second structure being independent and separate from the first structure;

wherein:

(i) each panel is defined by a foldable frame member that has a folded and an unfolded orientation, and a sheet material covering the respective frame member when the respective frame member is in the unfolded orientation, each panel further having a left side and a right side;

(ii) the right side of the first panel is hingedly connected to the left side of the second panel, the right side of the third panel is hingedly connected to the left side of the fourth panel, the left side of the first panel is removably connected to the right side of the fourth panel, and the right side of the second panel is removably connected to the left side of the third panel, with the four panels connected together and oriented vertically to form a ring of panels that define a space therebetween;

(iii) the first and second panels have different shapes with the second panel being less then half the size of the first panel, and the third and fourth panels have different shapes with the fourth panel being less than half the size of the third panel;

(iv) each frame member forms a plurality of concentric frame members when it has been twisted and folded into the folded orientation; and (v) the item of furniture is positioned in the space and surrounded by the ring of panels.

2. The combination of claim 1, wherein each panel has a periphery, and further including a peripheral sleeve extending along the periphery of each panel for retaining the respective frame member.

3. The combination of claim 1, wherein the first and third panels have a first shape, and the second and fourth panels have a second shape that is different from the first shape.

* * * * *